US010721561B2

(12) United States Patent
Jain et al.

(10) Patent No.: US 10,721,561 B2
(45) Date of Patent: Jul. 21, 2020

(54) ADAPTIVE FEEDBACK NOISE CANCELLATION OF A SINUSOIDAL DISTURBANCE

(71) Applicant: Bose Corporation, Framingham, MA (US)

(72) Inventors: Ankita D. Jain, Westborough, MA (US); Wade P. Torres, Attleboro, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/172,154

(22) Filed: Oct. 26, 2018

(65) Prior Publication Data

US 2019/0132678 A1 May 2, 2019

Related U.S. Application Data

(60) Provisional application No. 62/577,340, filed on Oct. 26, 2017.

(51) Int. Cl.
*H04R 3/04* (2006.01)
*H04R 3/00* (2006.01)
(Continued)

(52) U.S. Cl.
CPC ..... *H04R 3/04* (2013.01); *G10K 11/178* (2013.01); *G10K 11/17875* (2018.01);
(Continued)

(58) Field of Classification Search
CPC .... H04R 3/04; H04R 3/005; G10K 11/17875; G10K 11/178; G10L 21/0224; G10L 2021/02166
(Continued)

(56) References Cited

U.S. PATENT DOCUMENTS 8,098,837 B2 * 1/2012 Inoue ..... G10K 11/178 381/71.11
9,240,819 B1 * 1/2016 Ku ..... H04B 1/62
(Continued)

FOREIGN PATENT DOCUMENTS

DE 42 36 155 4/1994
WO WO 97/46176 12/1997

OTHER PUBLICATIONS

International Search Report and Written Opinion; PCT/US2018/057826; dated Jan. 30, 2019; 15 pages.
(Continued)

*Primary Examiner* — David L Ton
(74) *Attorney, Agent, or Firm* — Fish & Richardson P.C.

(57) ABSTRACT

The technology described this document can be embodied in a method that includes receiving an error signal captured using a microphone, the error signal representing a difference between the sinusoidal component of a noise signal and an output of an acoustic transducer. The output of the acoustic transducer is configured to reduce the effects of the sinusoidal component of the noise signal. The method includes processing the error signal to compensate for effects due to a signal path between the acoustic transducer and the microphone, and determining a current estimate of one or more first parameters of the error signal. Based on such parameters, a current estimate of a time-varying step size associated with an adaptive process is determined, and based on the current estimate of the time-varying step size, a driver signal configured to change the output of the acoustic transducer is generated.

18 Claims, 16 Drawing Sheets

(51) Int. Cl.
*G10K 11/178* (2006.01)
*G10L 21/0224* (2013.01)
*G10L 21/0216* (2013.01)

(52) U.S. Cl.
CPC ..... *G10L 21/0224* (2013.01); *H04R 3/005* (2013.01); *G10L 2021/02166* (2013.01)

(58) Field of Classification Search
USPC ..... 381/71.1, 71.14
See application file for complete search history.

(56) References Cited

U.S. PATENT DOCUMENTS 9,747,885 B2 * 8/2017 Goto ..... G10K 11/17813
2003/0053647 A1 3/2003 Kates
2003/0103635 A1 * 6/2003 Wright ..... G10K 11/178 381/71.8
2005/0207585 A1 * 9/2005 Christoph ..... G10K 11/178 381/71.11
2007/0233478 A1 * 10/2007 Sakamoto ..... G10K 11/178 704/233
2008/0181422 A1 * 7/2008 Christoph ..... G10K 11/17817 381/73.1
2008/0240455 A1 * 10/2008 Inoue ..... G10K 11/178 381/71.4
2010/0284546 A1 * 11/2010 DeBrunner ..... G10K 11/178 381/71.2
2012/0170766 A1 * 7/2012 Alves ..... G10K 11/178 381/71.11
2015/0055787 A1 2/2015 Ganeshkumar
2015/0086031 A1 * 3/2015 Goto ..... G10K 11/178 381/71.8
2015/0189433 A1 * 7/2015 Ganeshkumar ..... H04R 3/002 381/71.4

OTHER PUBLICATIONS

Kuo et al.; "Active Noise Control: A Tutorial Review"; Proceedings of the IEEE, vol. 87, No. 6, Jun. 1999.

* cited by examiner

ADAPTIVE FEEDBACK NOISE CANCELLATION OF A SINUSOIDAL DISTURBANCE

PRIORITY CLAIM

This application claims priority to U.S. Provisional Application 62/577,340, filed on Oct. 26, 2017, the entire content of which is incorporated herein by reference.

TECHNICAL FIELD

This disclosure generally relates to active noise cancellation, e.g., to generate a driver signal for an acoustic transducer to reduce the effect of a sinusoidal component of a noise signal.

BACKGROUND

In systems with one or more microphones and one or more acoustic transducers (e.g., speakers, drivers, etc.), a desired signal may be corrupted by a noise signal. The noise signal may include a sinusoidal component of unknown and time-varying frequency, amplitude, and phase. For active noise cancellation of the noise signal, a system can generate a driver signal configured to destructively interfere with the sinusoidal component of the noise signal.

SUMMARY

In one aspect, this document features a method for reducing effects of a sinusoidal component of a noise signal. The method includes receiving, at one or more processing devices, an error signal captured using a microphone. The error signal represents a difference between the sinusoidal component of the noise signal and an output of an acoustic transducer, the output of the acoustic transducer configured to reduce the effects of the sinusoidal component of the noise signal. The method also includes processing the error signal using a digital filter that is configured to compensate for effects due to a signal path between the acoustic transducer and the microphone, and determining, based on an output of the digital filter, a current estimate of one or more first parameters of the error signal. The method further includes determining, based at least on the one or more first parameters of the error signal, a current estimate of a time-varying step size associated with an adaptive process configured to generate a driver signal for the acoustic transducer, and generating, based on the current estimate of the time-varying step size, the driver signal. The driver signal is configured to change the output of the acoustic transducer.

In another aspect, this document features a system for reducing effects of a sinusoidal component of a noise signal. The system includes at least one microphone, and at least one acoustic transducer configured to generate an output that reduces the effects of the sinusoidal component of the noise signal. The system also includes a first digital filter that is configured to receive an error signal captured using the at least one microphone, the error signal representing a difference between the sinusoidal component of the noise signal and the output of the at least one acoustic transducer. The digital filter is configured to compensate for effects due to a signal path between the at least one acoustic transducer and the at least one microphone. The system further includes a noise reduction engine that includes a second digital filter that drives the at least one acoustic transducer. The noise reduction engine is configured to receive an output of the first digital filter, and determine, based on the output of the first digital filter, a current estimate of one or more first parameters of the error signal. The noise reduction engine is also configured to determine, based at least on the one or more first parameters of the error signal, a current estimate of a time-varying step size associated with an adaptive process configured to generate a driver signal for the at least one acoustic transducer, and generate, based on the current estimate of the time-varying step size, a driver signal. The driver signal is configured to change the output of the at least one acoustic transducer.

In another aspect, this document features one or more machine-readable storage devices having encoded thereon computer readable instructions for causing one or more processing devices to perform various operations. The operations include receiving an error signal captured using a microphone, the error signal representing a difference between a sinusoidal component of a noise signal and an output of an acoustic transducer. The output of the acoustic transducer is configured to reduce effects of the sinusoidal component of the noise signal. The operations also include processing the error signal to compensate for effects due to a signal path between the acoustic transducer and the microphone, to generate an intermediate signal, and determine, based on the intermediate signal, a current estimate of one or more first parameters of the error signal. The operations further include determining, based at least on the one or more first parameters of the error signal, a current estimate of a time-varying step size associated with an adaptive process configured to generate a driver signal for the acoustic transducer, and generating, based on the current estimate of the time-varying step size, the driver signal, wherein the driver signal is configured to change the output of the acoustic transducer.

The above aspects can include one or more of the following features.

The digital filter can include a time-varying bandpass filter, a passband of which is adjusted in accordance with one or more second parameters of the error signal. Adjusting the passband can include determining a center frequency associated with the passband. The effects of the sinusoidal component of the noise signal can be reduced using an array of acoustic transducers. The current estimate of the time-varying step size can be determined based on parameters representing effects of the error signal at multiple acoustic transducers of the array. The error signal can be captured using an array of multiple microphones.

In some implementations, the technology described herein may provide one or more of the following advantages.

By generating the driver signal using the error signal only, no prior knowledge of a reference signal is necessary to perform the active noise cancellation. The time-varying step size associated with the adaptive process improves stability of the system as the frequency, amplitude, and/or phase of the sinusoidal component of the noise signal changes over time. Compared to existing techniques, this improved stability enables active noise cancellation for sinusoidal disturbances with sudden changes in amplitude and frequency without assuming that they vary smoothly. The use of the time-varying bandpass filter ensures that only the sinusoidal component of the noise signal at the frequency of interest is being canceled, even as the current estimate of the sinusoidal frequency is updated.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

The technology described in this document is directed to actively cancelling a sinusoidal component of a noise signal by generating a driver signal for an acoustic transducer configured to destructively interfere with the noise signal. Acoustic transducers refer herein to devices that convert various forms of energy to acoustic energy such as speakers, drivers, etc. The system and method described adaptively generate the driver signal based on feedback, enabling cancellation of the sinusoidal component even in situations where the sinusoidal component has unknown and time-varying frequency, amplitude, and phase. In particular, the generated driver signal is based on error signals at the microphones and/or acoustic transducers, without any reference signal required. Furthermore, the parameters of the generated driver signal are updated in real time. A time-varying step size in the frequency update improves performance by ensuring stability of the system as the frequency, amplitude, and phase of the noise signal vary in time, even if the variations are not smooth. In addition, the inclusion of a time-varying bandpass filter, having a passband center frequency that changes instantaneously with the current estimate of the sinusoidal frequency, ensures that only the sinusoidal disturbance of the frequency of interest is cancelled. The technology described herein is not limited to implementations with a single microphone and a single speaker, but is scalable for systems comprising multiple microphones and/or an array of multiple acoustic transducers. Applications for the described technology include, but are not limited to cancellation of engine harmonic noise without the use of reference frequency from engine RPM; cancellation of in-car road noise of sinusoidal nature, such as acoustic modes of the car occurring near 40 Hz or tire cavity resonance around 200 Hz; and cancellation of sinusoidal modes of a room.

Figure 1:
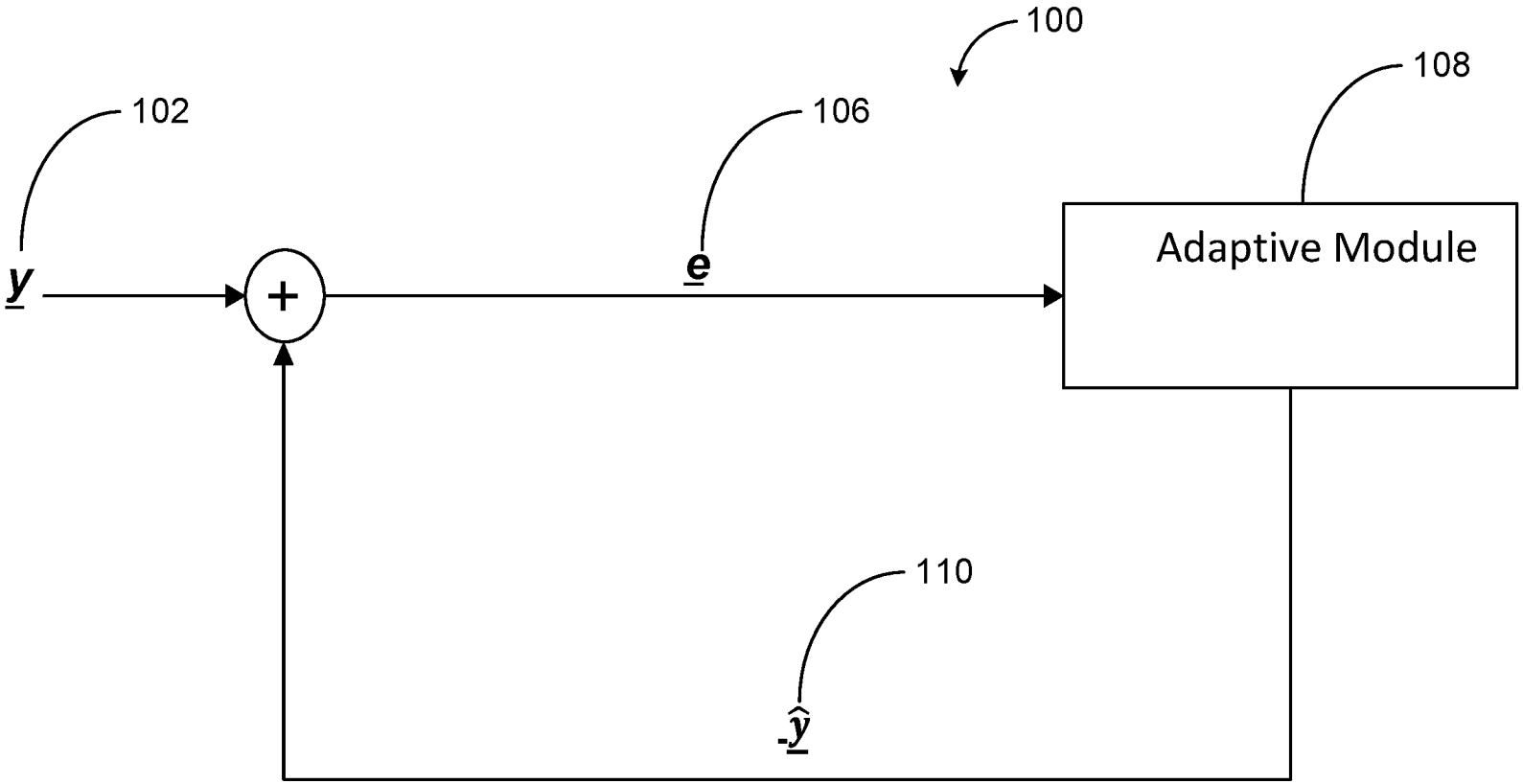
FIG. 1 is a block diagram of an example adaptive feedback noise cancellation system that minimizes error at the microphones.

FIG. 1 is a block diagram of an example system 100 configured to actively cancel sinusoidal disturbances of unknown and time-varying frequency, amplitudes, and phases. The system 100 is a feedback control system, with the adaptive module 108 able to access only the error signal 106 at the microphones (denoted as $\underline{e}$) without any reference signal required. The error signal 106 is calculated as the sum of the original sinusoidal disturbance 102 (denoted as $\underline{y}$) and the negative of the cancellation signal 110 (denoted as $-\underline{\hat{y}}$). The negative cancellation signal 110, is generated by the adaptive module 108 with the objective of minimizing the error at all microphones simultaneously. To minimize the error at the microphones, the adaptive module 108 updates the coefficients of the cancellation signal corresponding to the frequency, amplitude, and phase of the sinusoidal disturbance. In some cases, the sinusoidal disturbance can be a sinusoidal component of a more complex noise signal. Since the updates are performed in real time based on the error signal 106, the system 100 is referred to as an adaptive feedback system.

Figure 2:
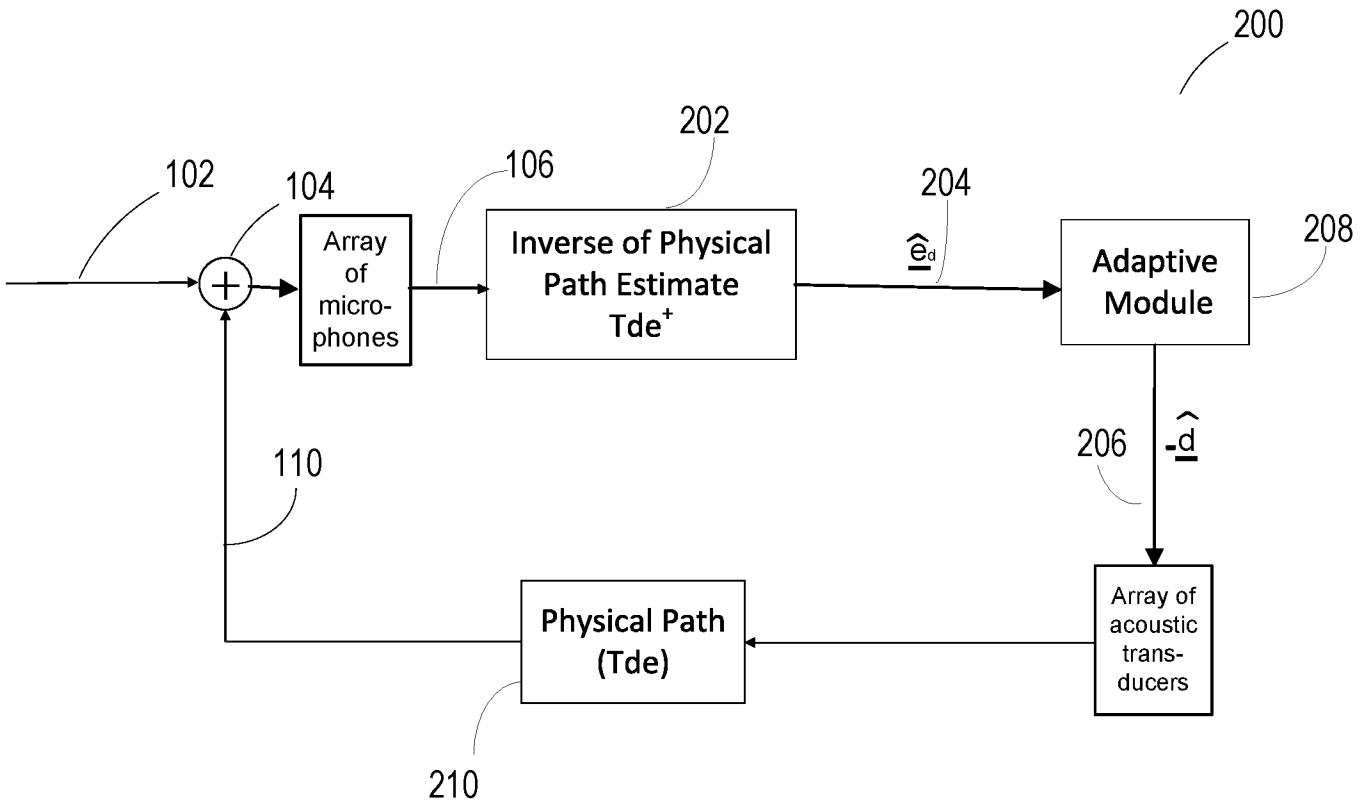
FIG. 2 is a block diagram of an example adaptive feedback noise cancellation system that minimizes error at the speakers.

FIG. 2 is a block diagram of an equivalent system 200 to the adaptive feedback system 100 shown in FIG. 1, but in which the adaptive module 108 acts based on the error signal 204 at acoustic transducers (denoted as $\underline{\hat{e}_d}$) rather than on the error signal 106 at the microphones. In the adaptive feedback system 200, the error signal 106 at the microphones (denoted as $\underline{e}$), is transformed to the error signal 204 at the acoustic transducers (denoted as $\underline{\hat{e}_d}$) by multiplication (in the frequency domain) with the inverse of the system transfer function from the drivers to the microphone (denoted as $\hat{T}_{de}^{+}$). Represented mathematically, $$\underline{\hat{e}_d} = \hat{T}_{de}^{+} * e \tag{1}$$

at the frequency of the cancellation signal. The system transfer function 210 ($\hat{T}_{de}$) and its inverse 202 ($\hat{T}_{de}^{+}$) are sometimes referred to as the physical path estimate from the drivers to the ears, and the inverse of the physical path estimate from the drivers to the ears, respectively. In some cases, the system transfer function 210 and its inverse can be implemented using one or more corresponding digital filters.

Analogously to the adaptive module 108 in system 100, the adaptive module 208 in system 200 acts upon the error signal at the acoustic transducers (also referred to as speakers or drivers), to generate a negative cancellation signal 206 ($-\hat{\underline{d}}$) for the drivers with the objective of minimizing the error signal 204. The negative cancellation signal 206 for the drivers is transformed back to a negative cancellation signal 110 at the microphones by multiplication with the system transfer function 210 ($\hat{T}_{de}$). Represented mathematically, $$-\hat{\underline{y}}=\hat{T}_{de}*(-\hat{\underline{d}}) \tag{2}$$

at the frequency of the cancellation signal. By formulating the equivalent mathematical problem as a minimization of error at the drivers rather than at the microphones, the cancellation signal generated as the output of the adaptive module 208 in system 200 can be directly sent to a speaker in real-life environments to minimize the error at the microphones, or at a listeners' ears.

The error minimization performed by the adaptive modules 108, 208 of adaptive feedback systems 100, 200 respectively, each entail updating in real-time the coefficients representing the frequency, amplitudes, and phases of a sinusoidal disturbance. For the purposes of the technology described, it is assumed that all microphones have the same disturbance frequency, but may have different amplitudes and phases. The sinusoidal disturbance of the i-th microphone is assumed to be of the form:

$$y_i(t)=A_{0,i}(t)\sin(\omega_0(t)t)+B_{0,i}(t)\cos(\omega_0(t)t)+\eta(t) \tag{3}$$

where $\omega_0(t)$ is the varying sinusoidal frequency, the combination of amplitudes $A_{0,i}(t)$ and $B_{0,i}(t)$ determines the net amplitude and phase of the sinusoidal disturbance, and $\eta(t)$ is uncorrelated noise. The cancellation signal produced by the drivers as measured at the microphone location is expressed as $$\hat{y}_i(t)=\hat{A}_i(t)\sin(\omega(t)t)+\hat{B}_i(t)\cos(\omega(t)t) \tag{4}$$

where $\omega(t)$ is the varying sinusoidal frequency estimate and the combination of amplitude estimates $\hat{A}_i(t)$ and $\hat{B}_i(t)$ determine the net amplitude and phase of the sinusoidal disturbance estimate. The objective of the module is that over time, $$\omega(t)\rightarrow\omega_0(t)$$

$$\hat{A}_i(t)\rightarrow A_{0,i}(t)$$

$$\hat{B}_i(t)\rightarrow B_{0,i}(t)$$

such that the estimated parameters of the cancellation signal converge to the corresponding actual parameters of the sinusoidal disturbance. The magnitude and phase of the sinusoidal disturbance at each microphone is not explicitly solved for, but is captured by the amplitude estimates $\hat{A}_i(t)$ and $\hat{B}_i(t)$ of the sine and cosine terms respectively, that when added together yield the sinusoid with the same magnitude and phase as that of the original disturbance.

Assuming that the system comprises N microphones and M speakers, where N≥1, and M≥1, the vector $\underline{e}(t)$ in FIG. 1 represents the error signal 106 at the microphones, where the error at the i-th microphone is given by $$e_i(t)=y_i(t)-\hat{y}_i(t)=A_{0,i}(t)\sin(\omega_0(t)t)+B_{0,i}(t)\cos(\omega_0(t)t)-\hat{A}_i(t)\sin(\omega(t)t)-\hat{B}_i(t)\cos(\omega(t)t)+\eta(t). \tag{5}$$

Next, as described in relation to FIG. 2 and Eqn. 1, a product of the error and the pseudo-inverse of the plant transfer function at the current frequency estimate yields the error at the driver signals, $\widehat{\underline{e_d}}$. The error of the driver signal can be interpreted as the difference between the driver signal required to create the disturbance sound field due to the original noise source at the microphones and that needed to cancel it. The former may or may not be able to accurately represent the noise field at the microphones depending on the number of microphones (N), compared to the number of drivers (M). Each element of this driver signal error vector $\widehat{\underline{e_d}}$ can be expressed as $$\hat{e}_{d,j}(t)=d_j(t)-\hat{d}_j(t)=C_{0,j}(t)\sin(\omega_0(t)t)+D_{0,j}(t)\cos(\omega_0(t)t)-\hat{C}_j(t)\sin(\omega(t)t)-\hat{D}_j(t)\cos(\omega(t)t)+\eta(t) \tag{6}$$

where $d_j$ is the true value of the j-th speaker signal in order to re-create the sound field at microphones due to the original disturbance, $\hat{d}_j$ is the estimate of the speaker signal as obtained by the adaptive module 208 to cancel this sound field, and C's and D's are respectively the amplitudes of the sines and cosines at the speaker, similar to the A's and B's described above for the microphones.

When the true plant transfer function is similar to its estimate used in the pseudo-inverse calculation, minimizing the total error at the microphones is mathematically similar to minimizing the total error of the driver signals given by $$\min J=\min \Sigma_j^M \hat{e}_{d,j}(t)|^2. \tag{7}$$

Incremental increase in frequency, $\Delta\omega$, is obtained as the derivative of the magnitude square of the error with respect to $\omega(t)$ as $$\Delta\omega \propto \frac{\partial J}{\partial \omega(t)} = \sum_j^M 2\hat{e}_{d,j}(t)\left[-\hat{C}_j(t)\cos(\omega(t)t)+\hat{D}_j(t)\sin(\omega(t)t)\right]t. \tag{8}$$

In some implementations, the time t at the end of equation 8 can be dropped because it is a positive quantity that does not have any bearing on the step direction, but arbitrarily scales the step size with time. Then, the update equation in discrete time for the frequency from time step n to n+1 is given by $$\omega[n+1]=\omega[n]-\mu_\omega\Delta\omega=\omega[n]-\mu_\omega\Sigma_j^M 2\,\hat{e}_{d,j}(t)[-\hat{C}_j(t)\cos(\omega(t)t)+\hat{D}_j(t)\sin(\omega(t)t)] \tag{9}$$

where the step direction is the negative of the cost function gradient and $\mu_\omega$ is the step size parameter for frequency.

Update equations for amplitude coefficients $\hat{C}_j(t)$ and $\hat{D}_j(t)$ for the j-th speaker can be calculated similarly. Taking a product of the error $\hat{e}_{d,j}(t)$ with $\sin(\omega(t)t)$, after dropping the time dependency term in $\omega$'s for brevity, yields, $$\hat{e}_{d,j}(t)\sin(\omega(t)t) = \frac{C_{o,j}}{2}(\cos((\omega_o+\omega)t)+\cos((\omega_o-\omega)t))-\frac{\hat{C}_j}{2}(-\cos(2\omega t))+\frac{D_{o,j}}{2}(\sin((\omega_0+\omega)t)-\sin((\omega_o-\omega)t))-\frac{\hat{D}_j}{2}(\sin(2\omega t)). \tag{10}$$

Without loss of generality, the signal given by Eqn. 10 can be processed using a low-pass filter with a cutoff frequency $\omega_c<\omega_0$ so that the terms with frequency $\omega_0+\omega$ and $2\omega$ vanish under the assumption that $2\omega>\omega_0$. Denoting $\Delta\hat{C}_j=C_{0,j}(t)-\hat{C}_j(t)$ and $\Delta\hat{D}_j=D_{0,j}(t)-\hat{D}_j(t)$, this yields:

$$\hat{e}_{d,j}(t)\sin(\omega(t)t) = \frac{C_{o,j}(t)}{2}\cos(\Delta\omega t) - \frac{D_{o,j}(t)}{2}\sin(\Delta\omega t) - \frac{\hat{C}_j(t)}{2} = \frac{\hat{C}_j(t)+\Delta\hat{C}_j}{2}\cos(\Delta\omega t) - \frac{\hat{D}_j(t)+\Delta\hat{D}_j}{2}\sin(\Delta\omega t) - \frac{\hat{C}_j(t)}{2}. \tag{11}$$

Similarly, taking a product of $\hat{e}_{d,j}(t)$ with cos(ω(t)t) yields:

$$\hat{e}_{d,j}(t)\cos(\omega(t)t) = \frac{\hat{C}_j(t)+\Delta\hat{C}_j}{2}\sin(\Delta\omega t) + \frac{\hat{D}_j(t)+\Delta\hat{D}_j}{2}\cos(\Delta\omega t) - \frac{\hat{D}_j(t)}{2}. \tag{12}$$

In these equations, however, the terms $\Delta\hat{C}_j$, $\Delta\hat{D}_j$, and Δω appear as products and so neither of the amplitude errors can be expressed as a linear function of Δω. Taking products of Eqns. 11 and 12 with cos(Δωt) and sin(Δωt), respectively, yields:

$$\hat{e}_{d,j}(t)\sin(\omega(t)t)\cos(\Delta\omega t) = \frac{\hat{C}_j(t)}{2}[\cos(\Delta\omega t)]^2 - \frac{\hat{C}_j(t)}{2}\cos(\Delta\omega t) + \frac{\Delta\hat{C}_j}{2}[\cos(\Delta\omega t)]^2 - \frac{\hat{D}_j(t)}{2}\cos(\Delta\omega t)\sin(\Delta\omega t) - \frac{\Delta\hat{D}_j}{2}\cos(\Delta\omega t)\sin(\Delta\omega t) \tag{13}$$

$$\hat{e}_{d,j}(t)\cos(\omega(t)t)\sin(\Delta\omega t) = \frac{\hat{C}_j(t)}{2}[\sin(\Delta\omega t)]^2 - \frac{\hat{D}_j(t)}{2}\sin(\Delta\omega t) + \frac{\Delta\hat{C}_j}{2}[\sin(\Delta\omega t)]^2 + \frac{\hat{D}_j(t)}{2}\cos(\Delta\omega t)\sin(\Delta\omega t) - \frac{\Delta\hat{D}_j}{2}\cos(\Delta\omega t)\sin(\Delta\omega t). \tag{14}$$

Taking a sum of Eqns. 13 and 14 and solving for $\Delta\hat{C}_j$ and $\Delta\hat{D}_j$ yields, $$\Delta\hat{C}_j = 2\hat{e}_{d,j}(t)[\sin\omega t\cos\Delta\omega t + \cos\omega t\sin\Delta\omega t] + \hat{C}_j(t)\cos\Delta\omega t + \hat{D}_j(t)\sin\Delta\omega t - C_j(t) \tag{15}$$

$$\Delta\hat{D}_j = 2\hat{e}_{d,j}(t)[\cos\omega t\cos\Delta\omega t - \sin\omega t\sin\Delta\omega t] + \hat{D}_j(t)\cos\Delta\omega t - \hat{C}_j(t)\sin\Delta\omega t - D_j(t). \tag{16}$$

Finally, update equations for amplitude coefficients from time step n to n+1 are given by $$\hat{C}_j[n+1] = \hat{C}_j[n] + \mu\Delta\hat{C}_j \tag{17}$$

$$\hat{D}_j[n+1] = \hat{D}_j[n] + \mu\Delta\hat{D}_j \tag{18}$$

where μ is the step size parameter for amplitude, and $\Delta\hat{C}_j$ and $\Delta\hat{D}_j$ are given by Eqns. 15 and 16.

The parameters that are used in the module for convergence are the initial values of frequency and amplitudes, namely ω[0], $\hat{C}_j[0]$, $\hat{D}_j[0]$, and the step sizes for frequency and amplitudes, namely $\mu_\omega$ and μ.

A time-varying step size for frequency update can be given by $$\mu_\omega = \mu_{\omega 0}\frac{1}{\sum_j^M \hat{C}_j[0]^2 + \hat{D}_j[0]^2 + \hat{C}_j[n]^2 + \hat{D}_j[n]^2} \tag{19}$$

Where $\mu_{\omega 0}$ is a one-time tuning value of the step size, $\hat{C}_j[0]$ and $\hat{D}_j[0]$ are initial estimates of the disturbance amplitudes at the j-th speaker, and $\hat{C}_j[n]$ and $\hat{D}_j[n]$ are the instantaneous amplitude estimates as calculated by the adaptive module 208. Departing from conventional normalized least mean square (NLMS) algorithms, the addition term corresponding to the initial amplitude estimates provides an implicit upper bound on the step size, which prevents the module from going unstable. For example, when the instantaneous cancellation amplitudes are much smaller than the initial amplitude estimates, the addition of the $\hat{C}_j[0]^2$ and $\hat{D}_j[0]^2$ terms allows the step size to grow while preventing the step size from becoming too large. On the other hand, when the instantaneous amplitude estimates are much larger than the initial amplitude estimates, the adaptive module 208 takes smaller steps, proportional to the inverse of the cancellation signal energy. In this case, if the cancellation signal has not converged to the disturbance, the error will account for this discrepancy, and decreasing the step size proportionally enables stability.

To determine the initial estimates described above, an offline process can be implemented. For example, the disturbance signal $y_i(t)$ can be observed for a time period (e.g., 1-2 seconds) before enabling the adaptive module 208. During this time, less accurate estimates of the initial frequency and amplitude can be obtained, assuming the signal-to-noise ratio is high enough to be able to identify the spectral peak from $y_i(t)$. Once the adaptive module 208 is enabled, $y_i(t)$ is no longer available for use, and only $e_i(t)$ is.

Figure 3:
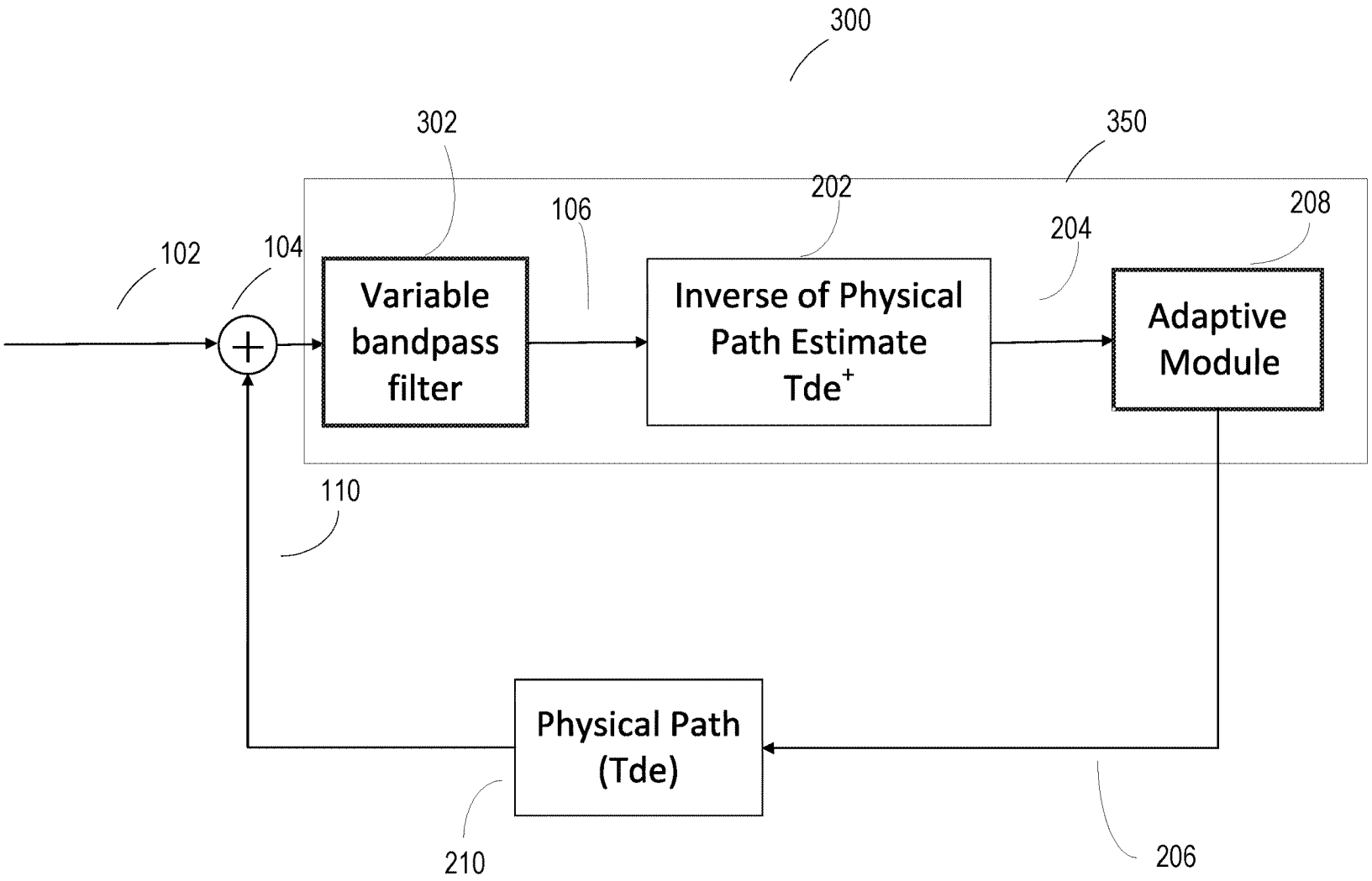
FIG. 3 is a block diagram of an example adaptive feedback system that includes a variable bandpass filter.

For real signals with multiple local spectral peaks, the adaptive module 208 can cancel a particular spectral peak of interest by implementing a variable bandpass filter with its center frequency following the instantaneous estimate of the disturbance frequency. Referring to FIG. 3, an adaptive feedback system 300 is similar to the adaptive feedback system 200 of FIG. 2, with the addition of a variable bandpass filter 302 which filters the error signal at the microphones to generate a filtered error signal 106. When the frequency estimate generated by the adaptive module 208 is close enough to the actual disturbance frequency, the filtered error signal 106 comes primarily from the spectral peak of interest and the module 208 is able to successfully cancel it. Additionally by instantaneously centering the bandpass filter (e.g., determining a location of the center frequency of the passband, without changing the bandwidth), the phase at and near the center frequency is close to zero and thus has minimal effect on the cancellation performance. In some implementations, the variable bandpass filter 302 and the adaptive module 208 can be disposed in a noise reduction engine 350 that includes one or more processing devices.

For a given fixed center frequency $\omega_c$, a bandpass filter can be represented by continuous state space equations as $$\dot{x}(t) = Px(t) + Qu(t) \tag{20}$$

$$e(t) = Rx(t) + Su(t) \tag{21}$$

where u(t) is the input signal, here equal to the unfiltered error at the microphones, e(t) is the filtered error signal 106, x(t) is an intermediate state variable, and P to S are the state matrices. The representation of a bandpass filter with time-varying center frequency equal to $\alpha(t)\omega_c$, where $\alpha(t)=\omega(t)/\omega_c$, is given by $$\dot{x}(t) = \alpha(t)(Px(t) + Qu(t)) \tag{22}$$

$$e(t) = Rx(t) + Su(t). \tag{23}$$

In discrete space with sampling time $t_s$, these equations transform to $$\frac{x[n+1]-x[n]}{t_s} = \alpha[n](Px[n]+Qu[n]) \tag{24}$$

$$e[n] = Rx[n]+Su[n] \tag{25}$$

Such that the new P and Q matrices are transformed to $$x[n+1]=(1+t_s\,\alpha[n]P)x[n]+t_s\,\alpha[n]Qu[n] \tag{26}$$

$$e[n]=Rx[n]+Su[n] \tag{27}$$

where $1+t_s\,\alpha[n]P$ represents the new P matrix and $t_s\,\alpha[n]Q$ represents the new Q matrix.

Figure 4A:
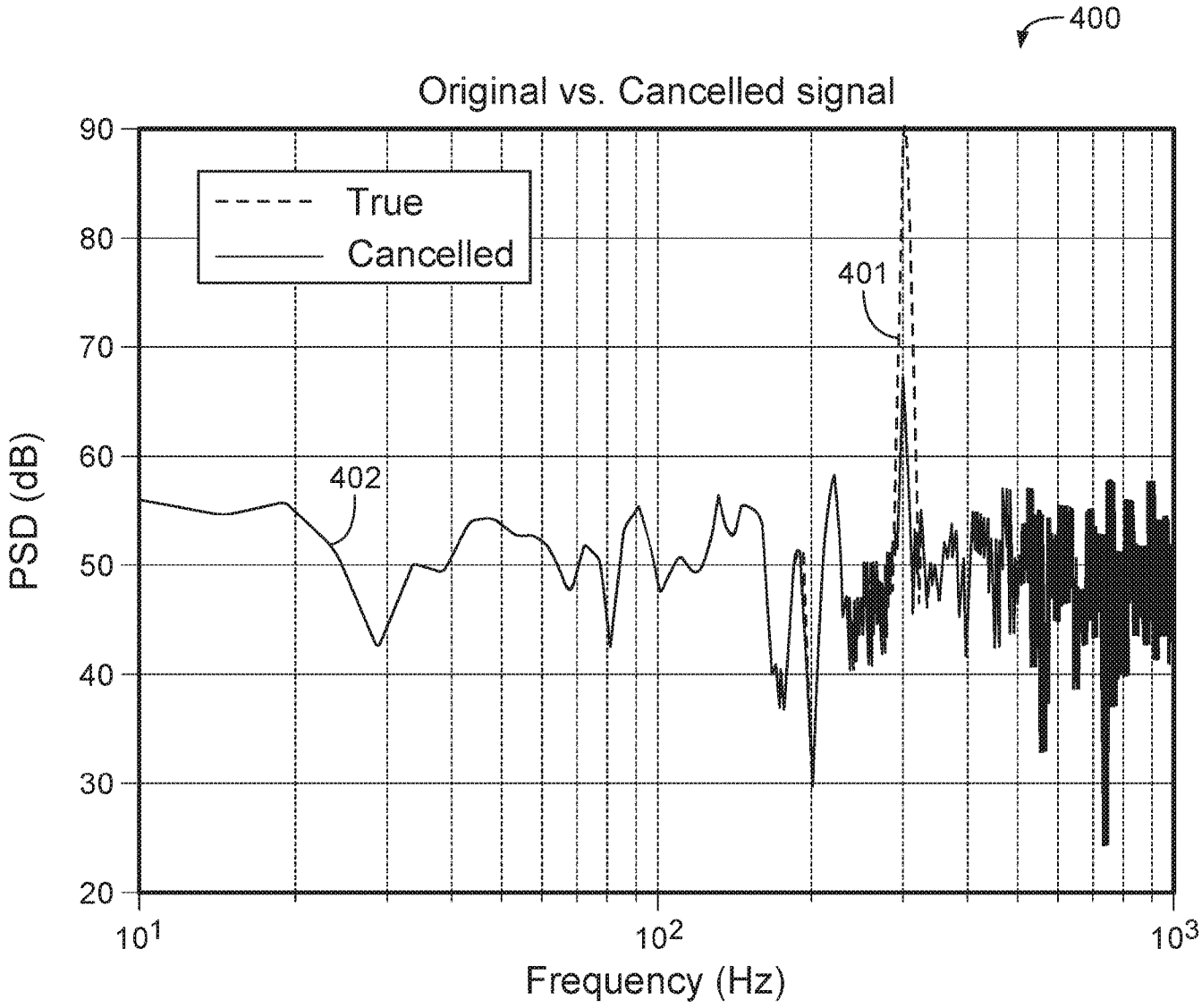
FIG. 4A illustrates the power spectral density (PSD) of an original signal with fixed frequency and amplitude compared to the PSD of a cancelled signal after implementing the adaptive feedback noise cancellation system of FIG. 3.
Figure 4B:
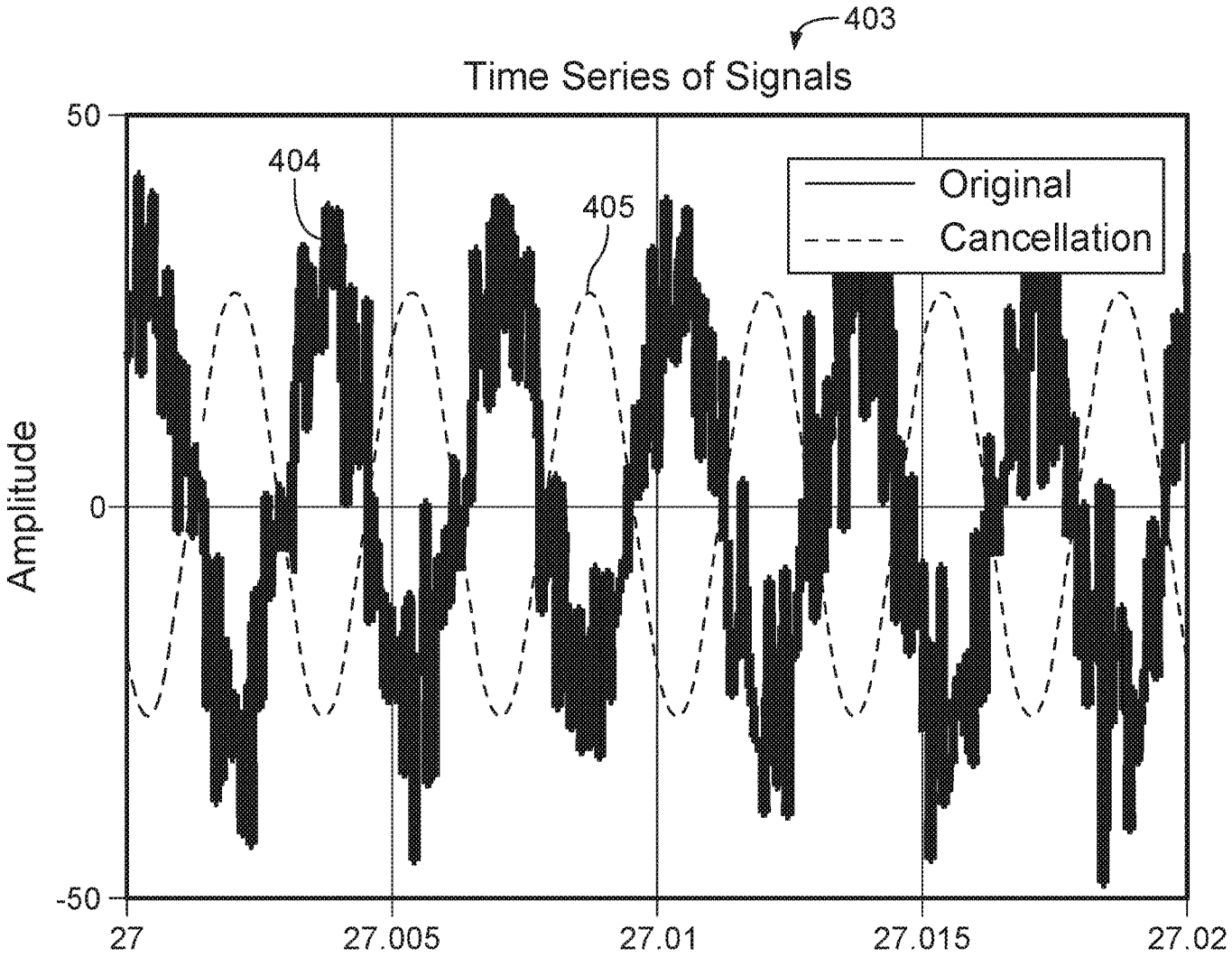
FIG. 4B illustrates the time series of the original signal of FIG. 4A and a cancellation signal generated by the adaptive feedback noise cancellation system of FIG. 3.
Figure 4C:
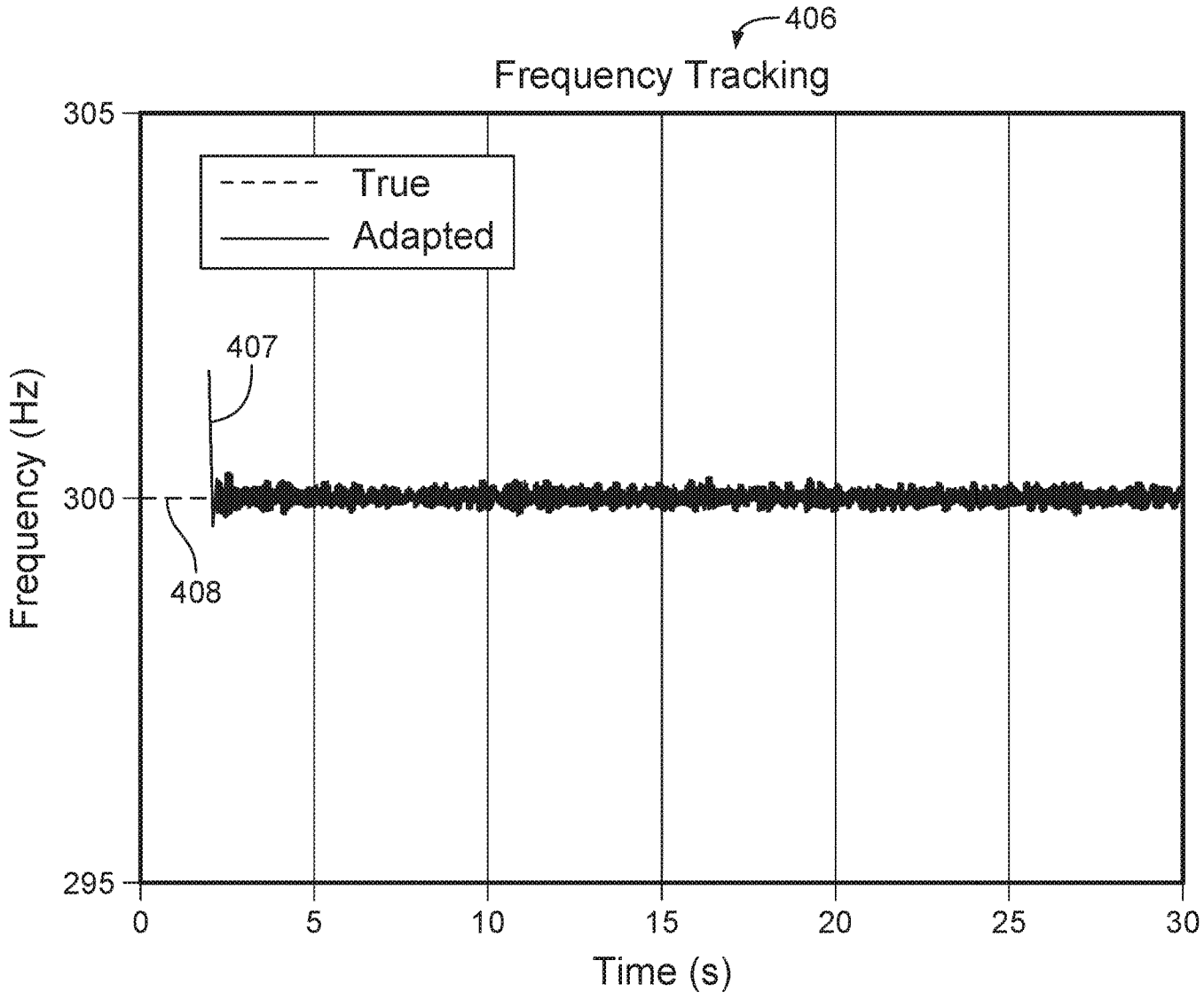
FIG. 4C illustrates the true frequency of the original signal of FIG. 4A compared to the adapted frequency of the generated cancellation signal over time.
Figure 4D:
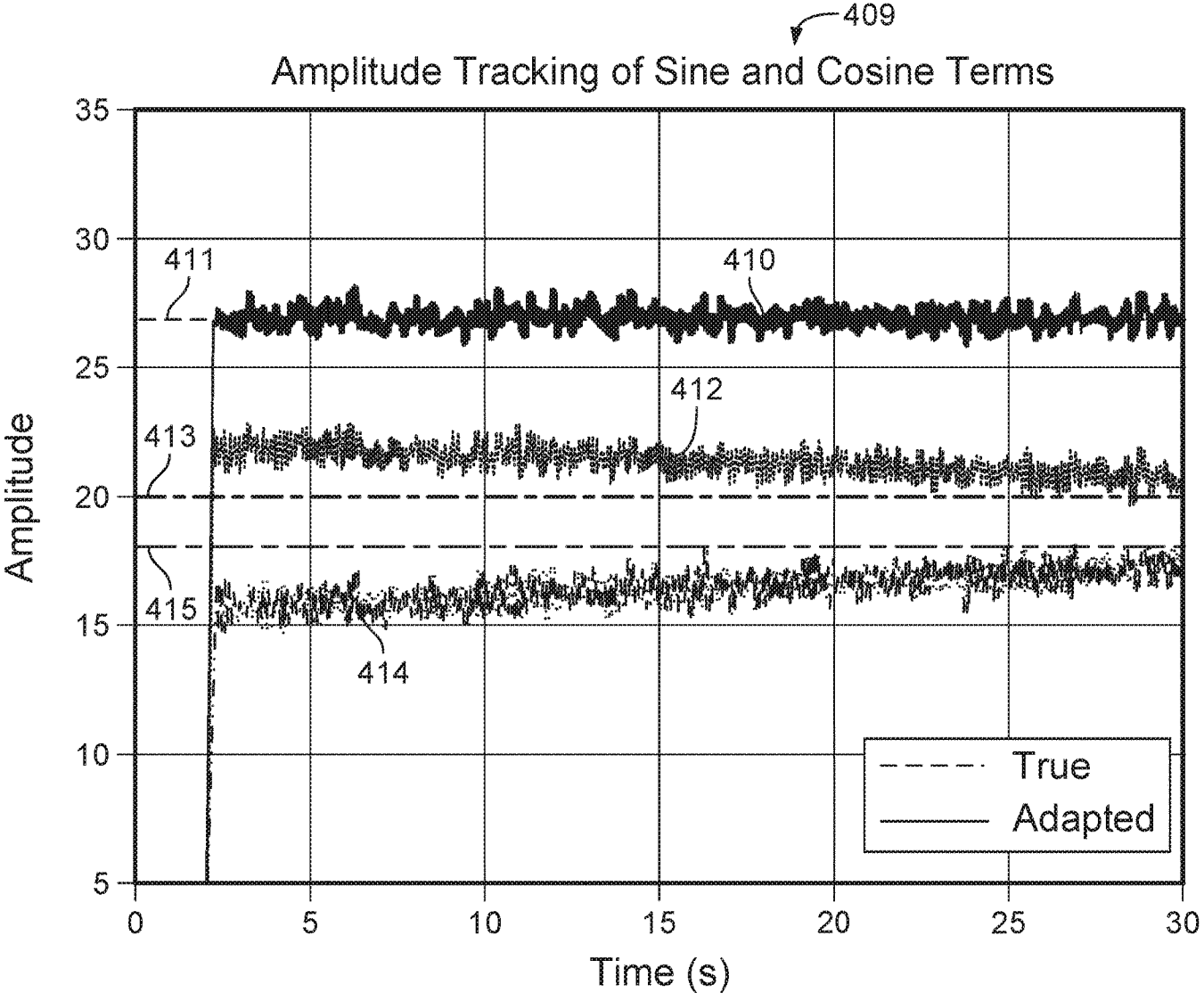
FIG. 4D illustrates the true amplitudes of the sine and cosine terms of the original signal of FIG. 4A compared to the adapted amplitudes of the sine and cosine terms of the generated cancellation signal over time.

Referring to FIGS. 4A-D, the adaptive feedback system 300 was evaluated for its ability to cancel a sinusoidal disturbance with fixed frequency and amplitude. FIG. 4A presents a graph 400 that shows the power spectral density (PSD) of an original signal 401 with fixed frequency and amplitude compared to the PSD of a cancelled signal 402 after implementing the adaptive feedback noise cancellation system 300. As can be seen, after implementing the adaptive feedback noise cancellation system 300, the cancelled signal 402 had a lower peak PSD than the original signal 401. FIG. 4B presents a graph 403 that shows the time series of the original signal 404 of FIG. 4A and a cancellation signal 405 generated by the adaptive feedback noise cancellation system 300. As shown in the figure, the cancellation signal 405 is out of phase with the original signal 404 such that it cancels the noise of the original signal 404 through deconstructive interference. FIG. 4C presents a graph 406 showing the true frequency of the original signal 408 of FIG. 4A compared to the adapted frequency of the generated cancellation signal 407 over time. Despite an initial disparity between the adapted frequency 407 and the true frequency 408, the adapted frequency 407 converges to the true frequency 408 fast (e.g., within less than a second), and substantially tracks the true frequency 408 for the rest of the time series. FIG. 4D presents a graph 409 showing the true amplitudes of the sine and cosine terms of the original signal of FIG. 4A compared to the adapted amplitudes of the sine and cosine terms of the generated cancellation signal over time. The true net amplitude is denoted as 411 while the true amplitudes of the sine and cosine terms of the original signal are represented by the reference numerals 413 and 415, respectively. The estimated net amplitude is represented by the reference numeral 410 while the estimated amplitudes of the sine and cosine terms of the adapted cancellation signal are represented using reference numerals 412 and 414, respectively. While the estimated amplitudes of the sine and cosine terms (412 and 414, respectively) differ from the true sine and cosine amplitudes (413 and 415, respectively), this is attributable to ambiguities in solution values due to the quadratic nature of the equation used to solve for them. Also, the net estimated amplitude 410 is shown to quickly converge and closely track the true net amplitude 411, suggesting successful overall performance of the adaptive feedback noise cancellation system 300.

Figure 5A:
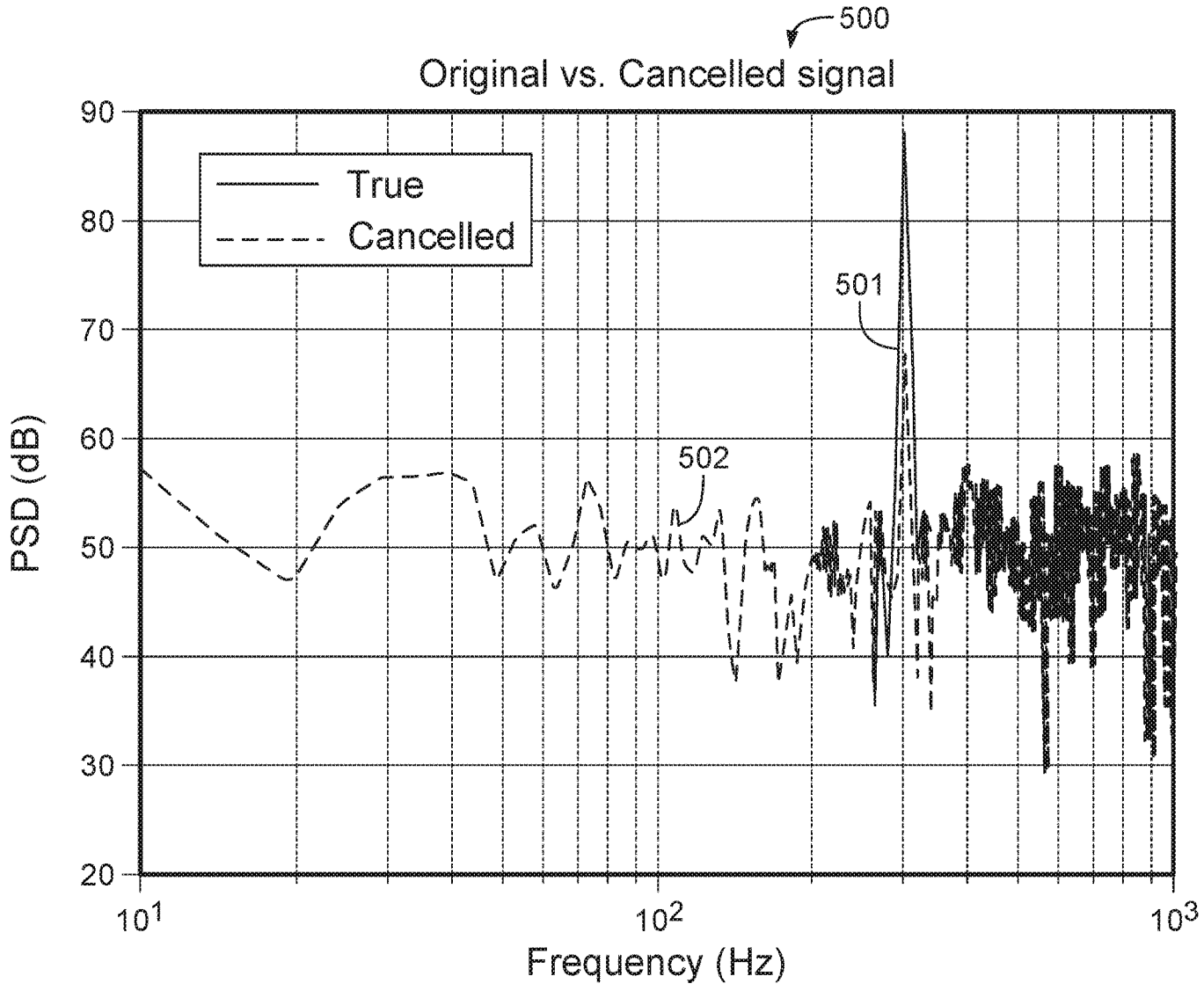
FIG. 5A illustrates the PSD of an original signal with smoothly varying frequency and amplitude compared to the PSD of a cancelled signal after implementing the adaptive feedback noise cancellation system of FIG. 3.
Figure 5B:
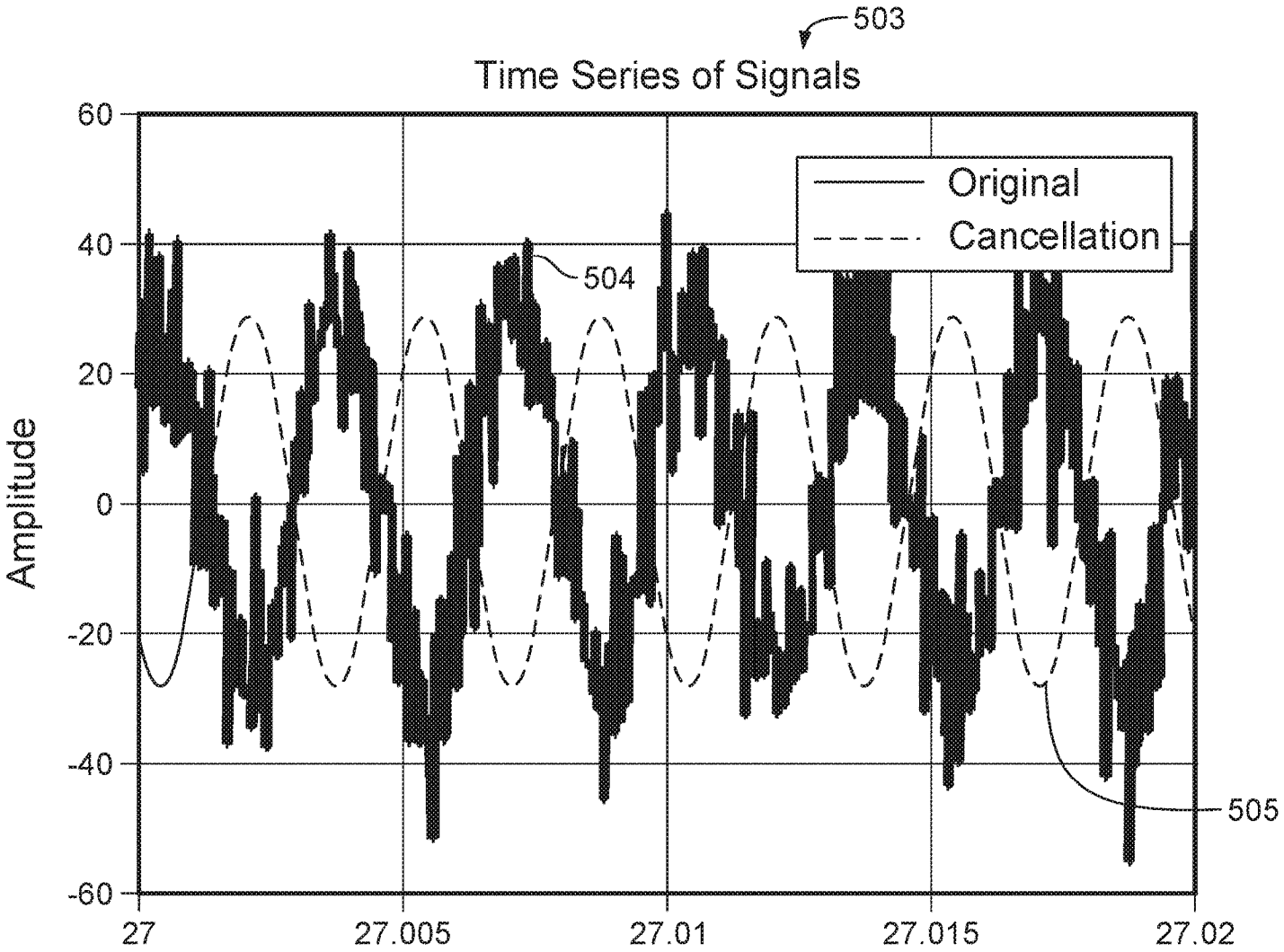
FIG. 5B illustrates the time series of the original signal of FIG. 5A and a cancellation signal generated by the adaptive feedback noise cancellation system of FIG. 3.
Figure 5C:
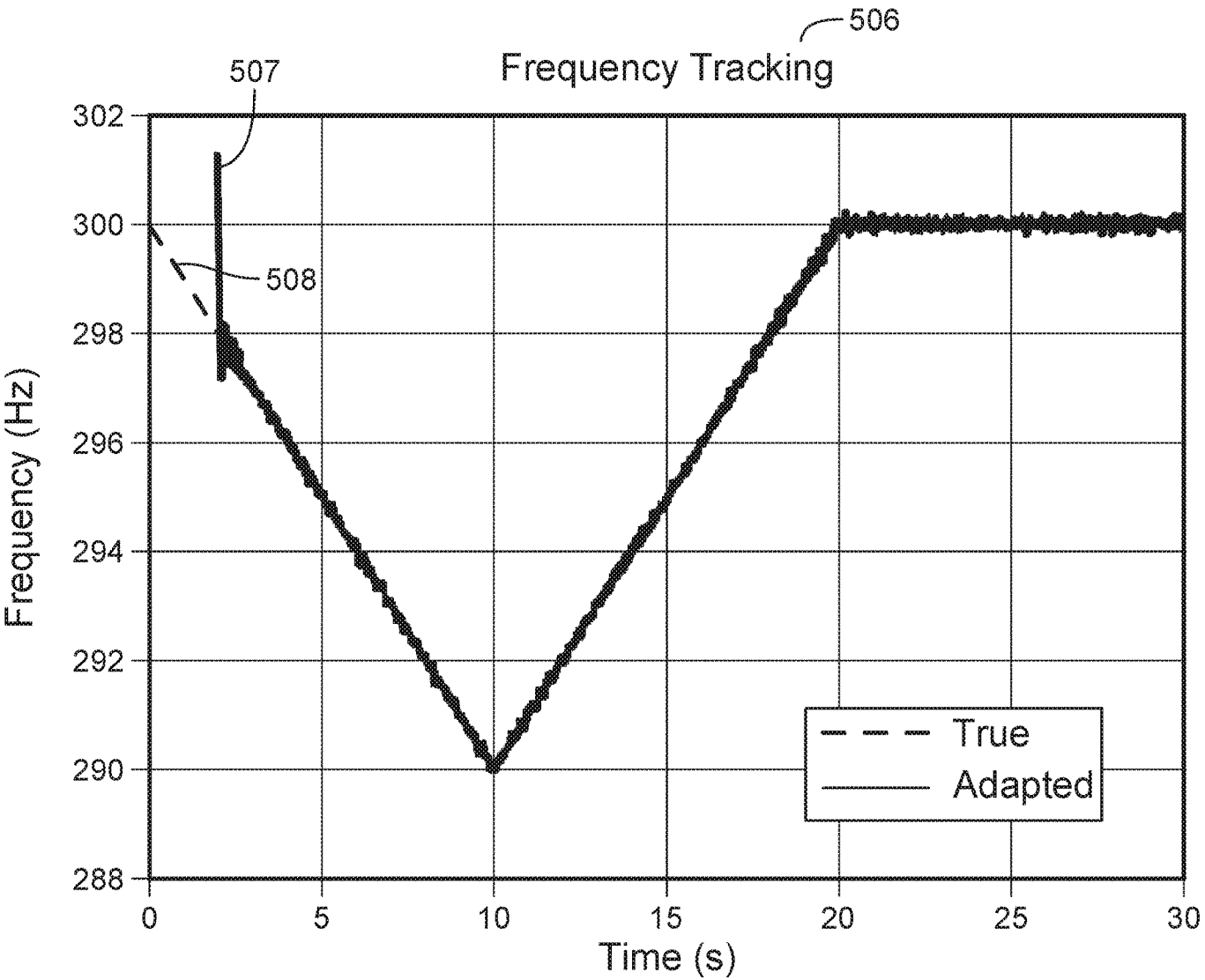
FIG. 5C illustrates the true frequency of the original signal of FIG. 5A compared to the adapted frequency of the generated cancellation signal over time.
Figure 5D:
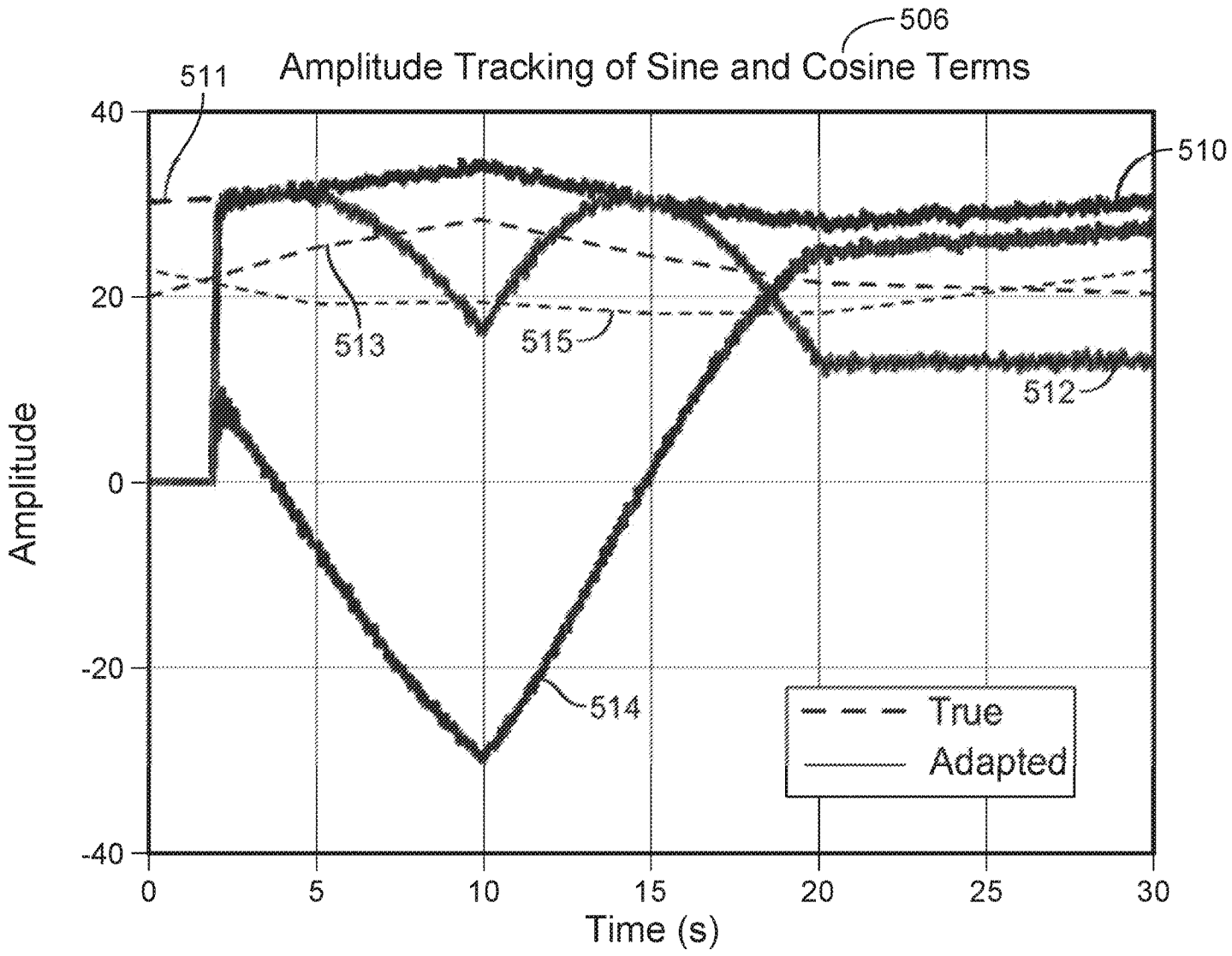
FIG. 5D illustrates the true amplitudes of the sine and cosine terms of the original signal of FIG. 5A compared to the adapted amplitudes of the sine and cosine terms of the generated cancellation signal over time.

Referring to FIGS. 5A-D, the adaptive feedback system 300 was also evaluated for its ability to cancel a sinusoidal disturbance with smoothly varying frequency and amplitude. FIG. 5A presents a graph 500 that shows the power spectral density (PSD) of an original signal 501 with fixed frequency and amplitude compared to the PSD of a cancelled signal 502 after implementing the adaptive feedback noise cancellation system 300. After implementing the adaptive feedback noise cancellation system 300, the cancelled signal 502 had a lower peak PSD than the original signal 501. FIG. 5B presents a graph 503 that shows the time series of the original signal 504 of FIG. 5A and a cancellation signal 505 generated by the adaptive feedback noise cancellation system 300. The cancellation signal 505 is out of phase with the original signal 504 such that it cancels the noise of the original signal 504 through deconstructive interference. FIG. 5C presents a graph 506 showing the true frequency of the original signal 508 of FIG. 5A compared to the adapted frequency 507 of the generated cancellation signal over time. Despite an initial disparity between the adapted frequency 507 and the true frequency 508, the adapted frequency 507 converges to the true frequency 508 fast (e.g., within less than a second), and accurately tracks the true frequency 508 for the rest of the time series. FIG. 5D presents a graph 509 showing the true amplitudes of the sine and cosine terms of the original signal of FIG. 5A compared to the adapted amplitudes of the sine and cosine terms of the generated cancellation signal over time. The true net amplitude is shown using the reference numeral 511, while the true amplitudes of the sine and cosine terms of the original signal are represented using the reference numerals 513 and 515, respectively. The estimated net amplitude is shown using the reference numeral 510, while the estimated amplitudes of the sine and cosine terms of the adapted cancellation signal are represented using the reference numerals 512 and 514, respectively. While the estimated amplitudes of the sine and cosine terms 512, 514 differ from the true sine and cosine amplitudes (513 and 515, respectively) this is largely attributed to ambiguities in solution values due to the quadratic nature of the equation used to solve for them. The net estimated amplitude 510 is shown to quickly converge and closely track the true net amplitude 511, suggesting successful overall performance of the adaptive feedback noise cancellation system 300.

Figure 6A:
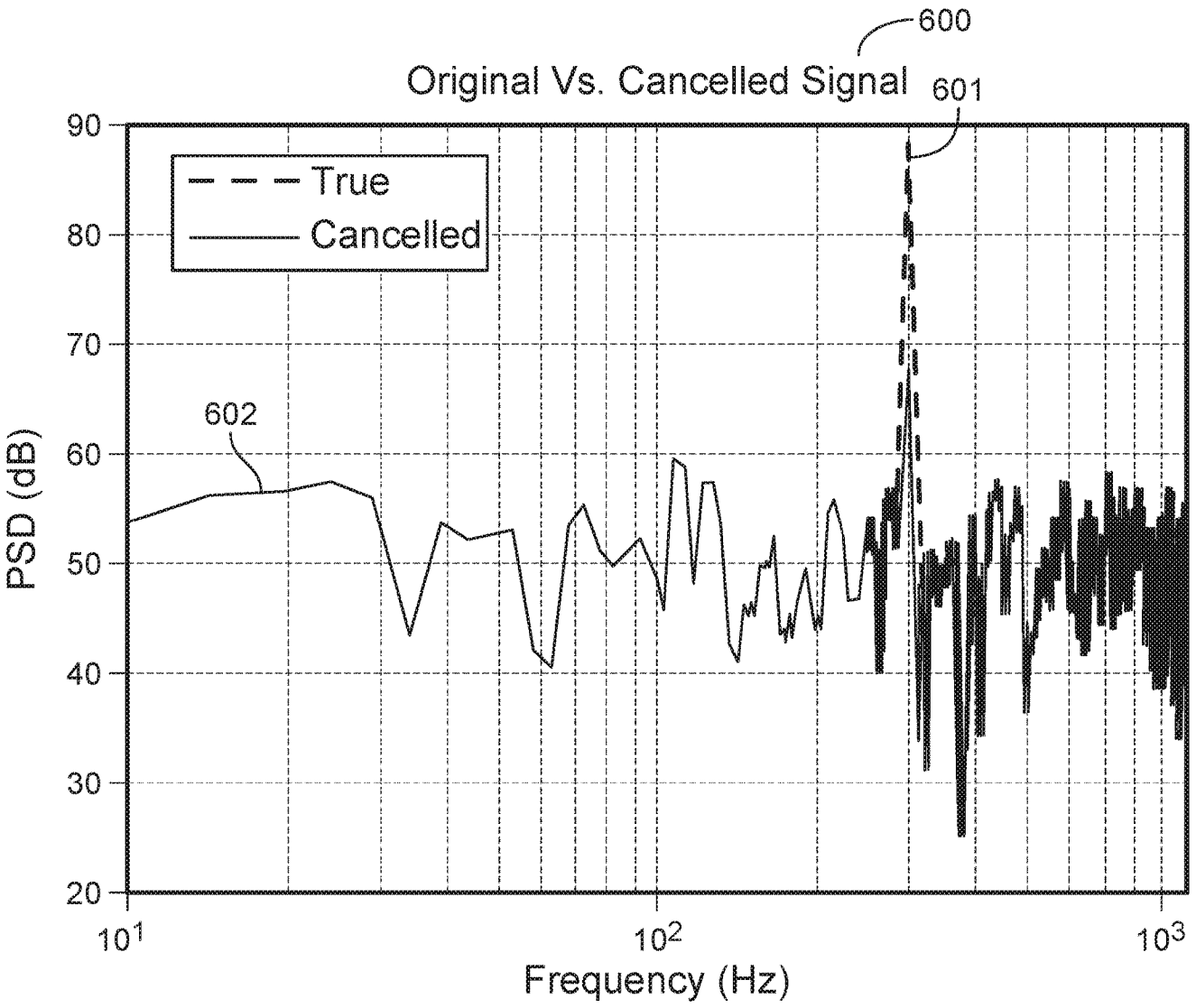
FIG. 6A illustrates the PSD of an original signal with discontinuous frequency and amplitude compared to the PSD of a cancelled signal after implementing the adaptive feedback noise cancellation system of FIG. 3.
Figure 6B:
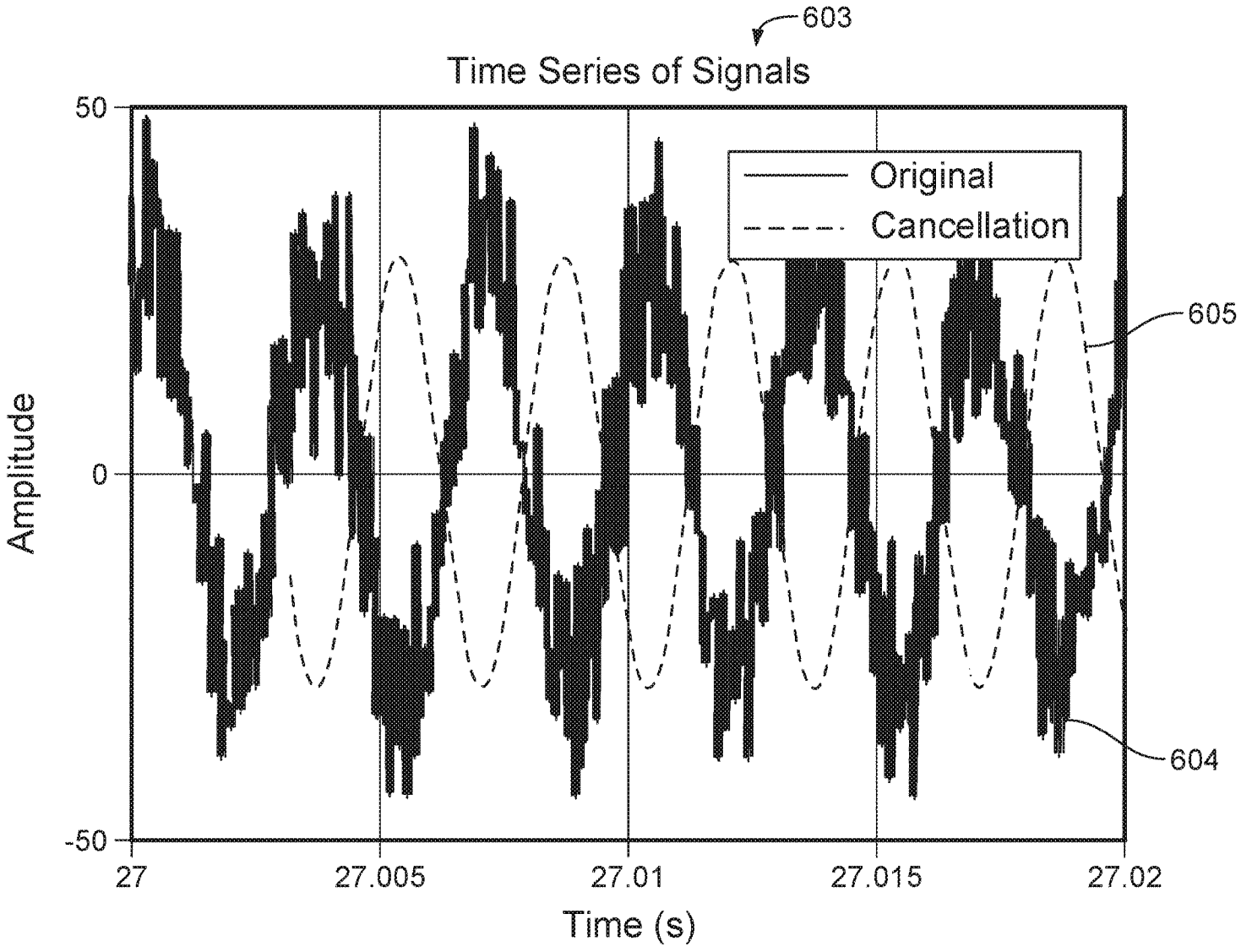
FIG. 6B illustrates the time series of the original signal of FIG. 6A and a cancellation signal generated by the adaptive feedback noise cancellation system of FIG. 3.
Figure 6C:
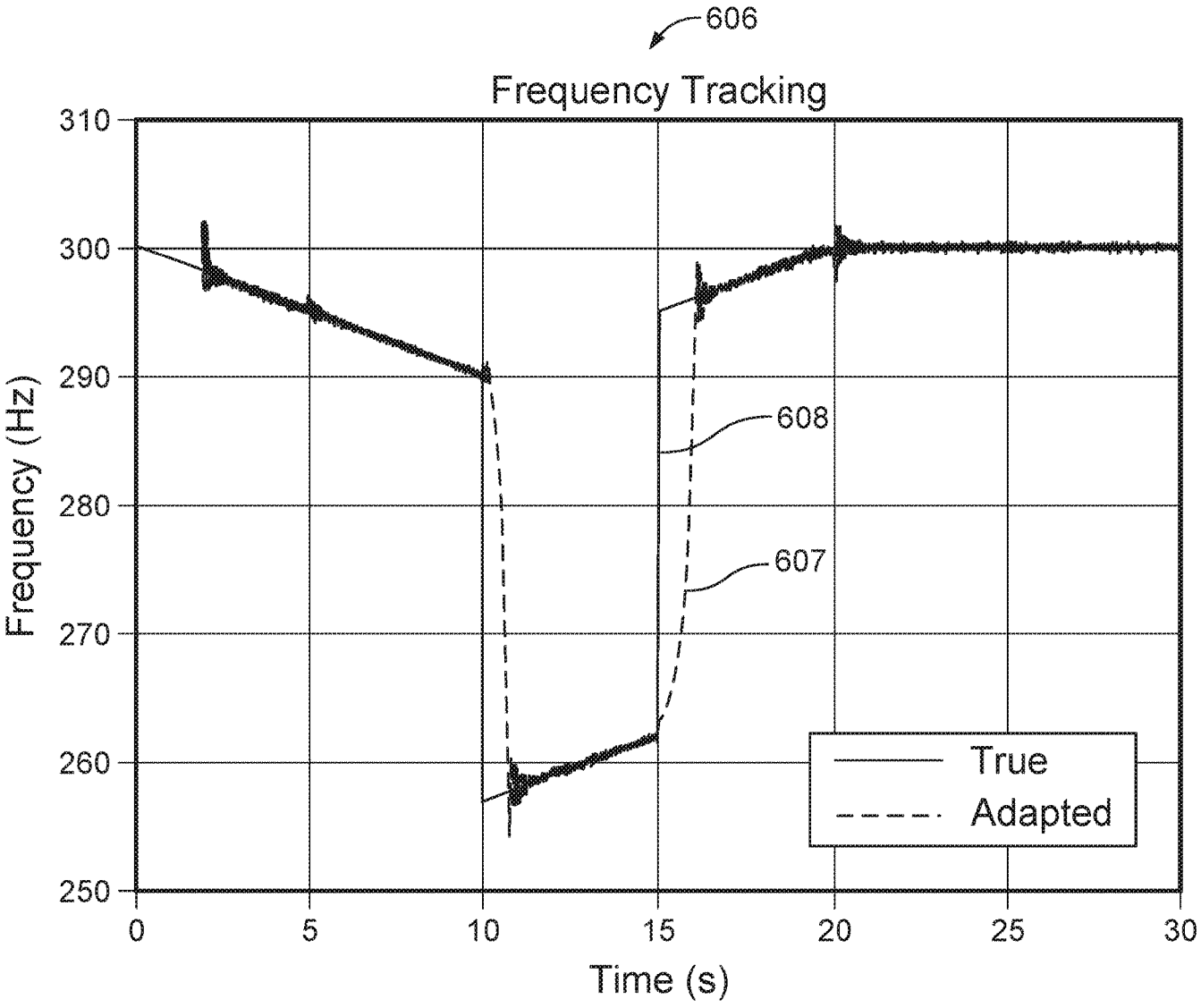
FIG. 6C illustrates the true frequency of the original signal of FIG. 6A compared to the adapted frequency of the generated cancellation signal over time.
Figure 6D:
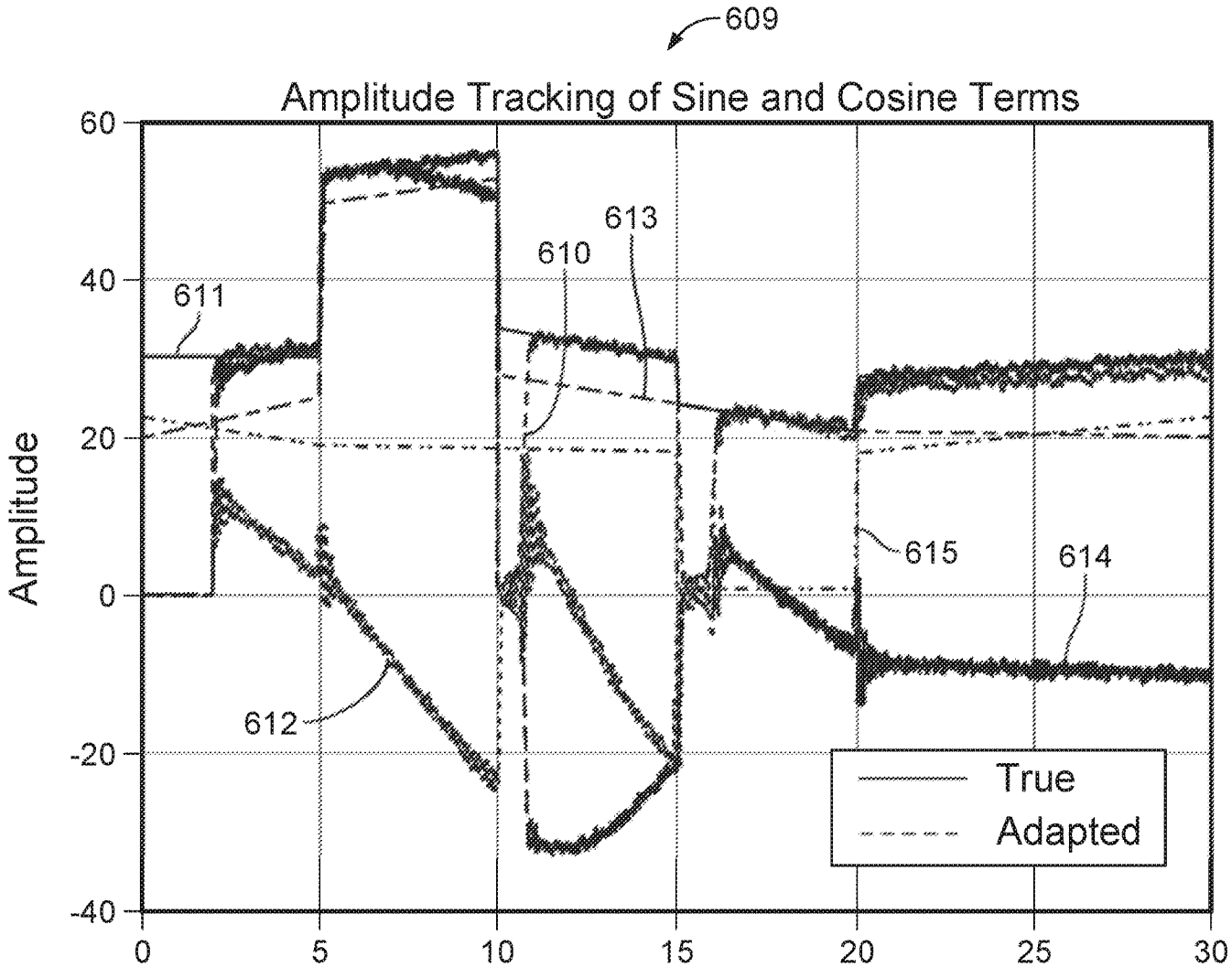
FIG. 6D illustrates the true amplitudes of the sine and cosine terms of the original signal of FIG. 6A compared to the adapted amplitudes of the sine and cosine terms of the generated cancellation signal over time.

Referring to FIGS. 6A-D, the adaptive feedback system 300 was additionally evaluated for its ability to cancel a sinusoidal disturbance with discontinuously varying frequency and amplitude. FIG. 6A presents a graph 600 that shows the power spectral density (PSD) of an original signal 601 with fixed frequency and amplitude compared to the PSD of a cancelled signal 602 after implementing the adaptive feedback noise cancellation system 300. As can be seen, after implementing the adaptive feedback noise cancellation system 300, the cancelled signal 602 had a lower peak PSD than the original signal 601. FIG. 6B presents a graph 603 that shows the time series of the original signal 604 of FIG. 6A and a cancellation signal 605 generated by the adaptive feedback noise cancellation system 300. It is clear that the cancellation signal 605 is out of phase with the original signal 604 such that it cancels the noise of the original signal 604 through deconstructive interference. FIG. 6C presents a graph 606 showing the true frequency of the original signal 608 of FIG. 4A compared to the adapted frequency of the generated cancellation signal 607 over time. Despite disparities immediately after discontinuous changes in the true frequency 608, the adapted frequency 607 consistently converges to the true frequency 608 fast (e.g., within 2-3 seconds or less), and accurately tracks the true frequency 608 for the full time series as the system maintains stability. FIG. 6D presents a graph 609 showing the true amplitudes of the sine and cosine terms of the original signal of FIG. 6A compared to the adapted amplitudes of the sine and cosine terms of the generated cancellation signal over time. The true net amplitude is represented using the reference numeral 611, while the true amplitudes of the sine and cosine terms of the original signal are represented using the reference numerals 613 and 615, respectively. The estimated net amplitude is represented using the reference numeral 610, while the estimated amplitudes of the sine and cosine terms of the adapted cancellation signal are represented using the reference numerals 612 and 614, respectively. While the estimated amplitudes of the sine and cosine terms (612 and 614, respectively) differ from the true sine and cosine amplitudes (613 and 615, respectively), this is largely attributed to ambiguities in solution values due to the quadratic nature of the equation used to solve for them. The net estimated amplitude 610 is shown to quickly converge to and track the true net amplitude 611, suggesting successful overall performance of the adaptive feedback noise cancellation system 300.

Figure 7:
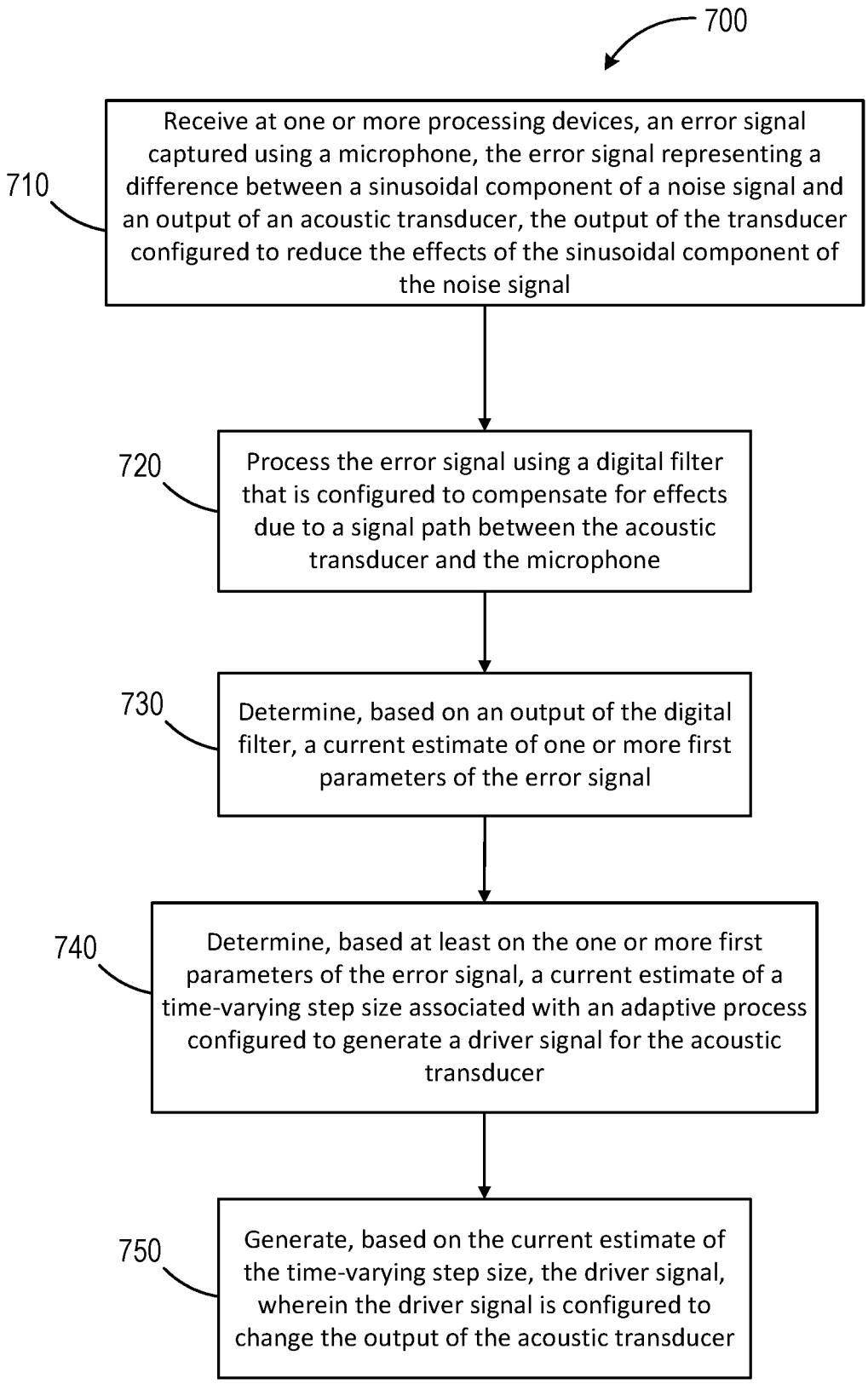
FIG. 7 is a flow chart illustrating a method for generating a cancellation signal via an adaptive feedback noise cancellation system.

FIG. 7 is a flow chart of an example process 700 for reducing effects of a sinusoidal component of a noise signal by generating a cancellation signal with the technology described herein. In some implementations, the operations of the process 700 can be executed, at least in part, by an adaptive feedback noise cancellation system (e.g., the systems 200, 300). Operations of the process 700 include receiving 710, at one or more processing devices, an error signal captured using a microphone. The error signal represents a difference between a sinusoidal component of a noise signal and an output of an acoustic transducer. For example, in some implementations, the error signal can correspond to $\hat{e}_{d,j}(t)$ from Eqn. 6. The output of the acoustic transducer is configured to reduce the effects of the sinusoidal component of the noise signal. For example, in some implementations, the effects of the sinusoidal component of the noise signal are reduced by deconstructive interference with the output of the acoustic transducer.

Operations of the process 700, can also include processing 720 the error signal using a digital filter that is configured to compensate for effects due to a signal path between the acoustic transducer and the microphone. In some implementations, the digital filter can correspond to the system transfer function from speakers to microphones, also referred to as the physical path estimate from drivers to ears, $\hat{T}_{de}$, or its inverse, $\hat{T}_{de}^{+}$.

Operations of the process 700 also include determining 730, based on an output of the digital filter, a current estimate of one or more first parameters of the error signal. In some implementations, the one or more first parameters of the error signal may include an estimated frequency of the original signal, estimates of the amplitudes of sine and cosine terms of the original signal, etc.

Operations of the process 700 further include determining 740, based at least on the one or more first parameters of the error signal, a current estimate of a time-varying step size associated with an adaptive process configured to generate a driver signal for the acoustic transducer. In some implementations, the time-varying step size can be estimated in accordance with Eqn. 19 to determine a step size for the frequency update of the adaptive module 208.

Operations of the process 700 also include generating 750, based on the current estimate of the time-varying step size, the driver signal, wherein the driver signal is configured to change the output of the acoustic transducer. In some implementations, the driver signal can correspond to $\hat{d}_j$ from Eqn. 6, where $\hat{d}_j$ is the estimate of the speaker signal obtained by the adaptive module 208 to cancel the sound field of the sinusoidal component of the noise signal.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory storage medium for execution by, or to control the operation of, data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable digital processor, a digital computer, or multiple digital processors or computers. The apparatus can also be or further include special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a standalone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit). For a system of one or more computers to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer readable media suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Control of the various systems described in this specification, or portions of them, can be implemented in a computer program product that includes instructions that are stored on one or more non-transitory machine-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any claims or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A method for reducing effects of a sinusoidal component of a noise signal, the method comprising:

receiving, at one or more processing devices, an error signal captured using a microphone, the error signal representing a difference between the sinusoidal component of the noise signal and an output of an acoustic transducer, the output of the acoustic transducer configured to reduce the effects of the sinusoidal component of the noise signal;

processing the error signal using a digital filter that is configured to compensate for effects due to a signal path between the acoustic transducer and the microphone;

determining, based on an output of the digital filter, a current estimate of one or more first parameters of the error signal;

determining, based at least on the one or more first parameters of the error signal, a current estimate of a time-varying step size associated with an adaptive process configured to generate a driver signal for the acoustic transducer; and generating, based on the current estimate of the time-varying step size, the driver signal, wherein the driver signal is configured to change the output of the acoustic transducer.

2. The method of claim 1, wherein the digital filter comprises a time-varying bandpass filter, a passband of which is adjusted in accordance with one or more second parameters of the error signal.

3. The method of claim 2, wherein adjusting the passband comprises determining a center frequency associated with the passband.

4. The method of claim 1, wherein the acoustic transducer is a part of an array of acoustic transducers.

5. The method of claim 4, wherein the current estimate of the time-varying step size is determined based on parameters representing effects of corresponding error signals at multiple acoustic transducers of the array.

6. The method of claim 1, wherein the error signal is captured using an array of multiple microphones.

7. A system for reducing effects of a sinusoidal component of a noise signal, comprising:

at least one microphone;

at least one acoustic transducer configured to generate an output that reduces the effects of the sinusoidal component of the noise signal;

a first digital filter that is configured to receive an error signal captured using the at least one microphone, the error signal representing a difference between the sinusoidal component of the noise signal and the output of the at least one acoustic transducer, wherein the digital filter is configured to compensate for effects due to a signal path between the at least one acoustic transducer and the at least one microphone; and a noise reduction engine comprising a second digital filter that drives the at least one acoustic transducer, the noise reduction engine configured to receive an output of the first digital filter, determine, based on the output of the first digital filter, a current estimate of one or more first parameters of the error signal, determine, based at least on the one or more first parameters of the error signal, a current estimate of a time-varying step size associated with an adaptive process configured to generate a driver signal for the at least one acoustic transducer, generate, based on the current estimate of the time-varying step size, a driver signal, wherein the driver signal is configured to change the output of the at least one acoustic transducer.

8. The system of claim 7, wherein the digital filter comprises a time-varying bandpass filter, a passband of which is adjusted in accordance with one or more second parameters of the error signal.

9. The system of claim 8, wherein adjusting the passband comprises determining a center frequency associated with the passband.

10. The system of claim 7, wherein the current estimate of the time-varying step size is determined based on parameters representing effects of the error signal at multiple acoustic transducers.

11. The system of claim 10, wherein two or more of the multiple acoustic transducers are driven by the driver signal.

12. The system of claim 11, wherein the error signal is captured using an array of multiple microphones, the array including the at least one microphone.

13. One or more machine-readable storage devices having encoded thereon computer readable instructions for causing one or more processing devices to perform operations comprising:

receiving an error signal captured using a microphone, the error signal representing a difference between a sinusoidal component of a noise signal and an output of an acoustic transducer, the output of the acoustic transducer configured to reduce effects of the sinusoidal component of the noise signal;

processing the error signal to compensate for effects due to a signal path between the acoustic transducer and the microphone, to generate an intermediate signal;

determining, based on the intermediate signal, a current estimate of one or more first parameters of the error signal;

determining, based at least on the one or more first parameters of the error signal, a current estimate of a time-varying step size associated with an adaptive process configured to generate a driver signal for the acoustic transducer; and generating, based on the current estimate of the time-varying step size, the driver signal, wherein the driver signal is configured to change the output of the acoustic transducer.

14. The one or more machine-readable storage devices of claim 13, further comprising instructions to implement a time-varying bandpass filter, a passband of which is adjusted in accordance with one or more second parameters of the error signal.

15. The one or more machine-readable storage devices of claim 14, wherein adjusting the passband comprises determining a center frequency associated with the passband.

16. The one or more machine-readable storage devices of claim 13, wherein the acoustic transducer is part of an array of acoustic transducers.

17. The one or more machine-readable storage devices of claim 16, wherein the current estimate of the time-varying step size is determined based on parameters representing effects of corresponding error signals at multiple acoustic transducers of the array.

18. The one or more machine-readable storage devices of claim 13, wherein the error signal is captured using an array of multiple microphones.

* * * * *